United States Patent [19]

Richter

[11] Patent Number: 5,053,108

[45] Date of Patent: Oct. 1, 1991

[54] HIGH SULFIDITY COOK FOR PAPER PULP USING BLACK LIQUOR SULFONIZATION OF STEAMED CHIPS

[75] Inventor: Johan C. F. C. Richter, Oslo, Norway

[73] Assignee: Kamyr AB, karlstad, Sweden

[21] Appl. No.: 372,624

[22] Filed: Jun. 28, 1989

[51] Int. Cl.[5] ..... D21C 7/12; D21C 7/14

[52] U.S. Cl. ..... 162/237; 162/241; 162/242; 162/248; 162/249; 162/19; 162/37; 162/39

[58] Field of Search ..... 162/19, 237, 239, 248, 162/249, 242, 241, 59, 29, 37, 39

[56] References Cited

U.S. PATENT DOCUMENTS

| | | | |
|---|---|---|---|
| 1,846,511 | 2/1932 | Darling | 162/59 |
| 1,933,017 | 10/1933 | Jansa et al. | 162/237 |
| 3,041,232 | 6/1962 | Richter et al. | 162/249 |
| 3,138,947 | 6/1964 | Johansen | 162/237 |
| 3,303,088 | 2/1967 | Gessner | 162/248 |
| 3,471,366 | 10/1969 | Reinhall | 162/237 |
| 3,745,063 | 7/1973 | Fisher | 162/239 |
| 3,802,956 | 4/1974 | Backlund | 162/19 |
| 3,902,962 | 9/1975 | Reinhall | 162/242 |
| 4,093,511 | 6/1978 | Richter | 162/237 |
| 4,104,113 | 8/1978 | Shriman et al. | 162/19 |
| 4,155,806 | 5/1979 | Mannbro | 162/19 |

*Primary Examiner*—Richard V. Fisher
*Assistant Examiner*—Todd J. Burns
*Attorney, Agent, or Firm*—Cushman, Darby & Cushman

[57] ABSTRACT

A method and apparatus provide for the continuous digestion of comminuted cellulosic fibrous material (e.g. wood chips) to produce paper pulp, with increased sulfidity. When black liquor is withdrawn from the continuous digester, instead of merely passing it to a pair of flash tanks and then to recovery, the concentrated liquor from a first flash tank is fed to a vessel in which the comminuted material is slurried with a liquid. Since the black liquor remains in intimate contact with the chips for a significant period of time, the lignin in the chips is partly sulfonized. Ultimately the black liquor is replaced with white liquor or the like, and the separated out black liquor is circulated to recovery or disposal. A high pressure feeder and a solids/liquid separator are utilized.

7 Claims, 3 Drawing Sheets

HIGH SULFIDITY COOK FOR PAPER PULP USING BLACK LIQUOR SULFONIZATION OF STEAMED CHIPS

BACKGROUND AND SUMMARY OF THE INVENTION

In the art of making paper pulp from comminuted cellulosic fibrous material, such as wood chips, utilizing a continuous digester, there is a continuing effort to improve the quality of the chemical pulp produced. For example in co-pending application Ser. No. 07/200,204 filed May 31, 1988, a method and apparatus are disclosed for enhancing the quality of chemical pulp by minimizing the mechanical action on the chips, especially when high temperature and pressure conditions exist or chemicals are present. Also that application teaches procedures for making the treatment more uniform. According to the present invention, it is again desired to even further increase the quality of the chemical pulp produced.

According to the present invention, the quality of the chemical pulp—particularly its tear strength and desired beating properties—is enhanced in a simple manner. In conventional systems, withdrawn black liquor is passed to a series of flash tanks to be concentrated, and then is passed to evaporators for ultimate recovery of the chemicals thereof. According to the present invention, the black liquor from the first flash tank is passed to a mechanism or earlier process step in which the comminuted cellulosic fibrous material is being slurried with a liquid. In this way, the material, such as wood chips, remains in contact with the black liquor for a significant period of time, the black liquor partly sulfonizing the lignin in the chips. Ultimately, the slurry is passed to a high pressure feeder, and then to a solids/-liquid separator, to separate out the black liquor to return it for ultimate recovery (including utilizing a second flash tank), whereupon white liquor or the like is added before the material is actually fed to the operative portions of a continuous digester for a chemical cook thereof at higher sulfidity than that of the white liquor added.

According to the present invention there is provided a method of continuously digesting comminuted cellulosic fibrous material, with increased sulfidity, to produce paper pulp utilizing a continuous digester. The method comprises the steps of: (a) Steaming the comminuted cellulosic fibrous material. (b) Slurrying the material with liquid. (c) Feeding the liquid slurry of steamed material to the digester. (d) Effecting kraft cooking of the material in the digester utilizing white liquor. (e) Withdrawing black liquor from the digester. (f) Recirculating the black liquor to the steamed comminuted cellulosic fibrous material in step (b) to provide at least part of the slurrying liquid. (g) Replacing the majority of the black liquor of the slurry with white liquor or the like prior to step (d), and separating out the replaced black liquor. And, (h) passing the separated out black liquor to recovery or disposal. Step (f) is preferably practiced by passing the black liquor to a first flash tank to produce steam and concentrated black liquor, and step (a) is practiced in part by utilizing the steam from the first flash tank.

According to another aspect of the present invention, there is provided apparatus for continuously digesting cellulosic fibrous material to produce chemical pulp. The apparatus comprises: (a) Steaming means for steaming the material. (b) Liquid slurrying means for producing a liquid slurry containing the steamed material. (c) A high pressure feeder having a low pressure inlet, low pressure outlet, high pressure inlet, and high pressure outlet. (d) A continuous digester. (e) Black liquor withdrawal means for withdrawing black liquor from the continuous digester. (f) A first flash tank containing steam and concentrated liquor outlets. (g) Connecting means for interconnecting the concentrated liquor outlet from the first flash tank to the slurrying means. (h) Black liquor recovery or disposal means. And, (i) means for operatively connecting the low pressure outlet of the high pressure feeder to the recovery or disposal means. The placement of the high pressure feeder and a solids/liquid separator depends upon the particular digester utilized. Digesters such as shown in said co-pending application Ser. No. 07/200,204 filed May 31, 1988, or in co-pending application Ser. No. 007/372,650 filed June 24, 1989 entitled "Continuous Cooking with Reduced Cost, Horsepower, and Pulp Degradation" or conventional continuous digesters, may be utilized. Slurrying of the material can take place in a chute disposed downstream of a horizontal steaming vessel, or in a vertical vessel having steaming at the top and a liquid level therein.

It is the primary object of the present invention to provide for the production of chemical pulp utilizing a continuous digester with enhanced quality as a result of increased sulfidity. This and other objects of the invention will become clear from an inspection of the detailed description of the invention, and from the appended claims.

DETAILED DESCRIPTION OF THE DRAWINGS

Figure 1:
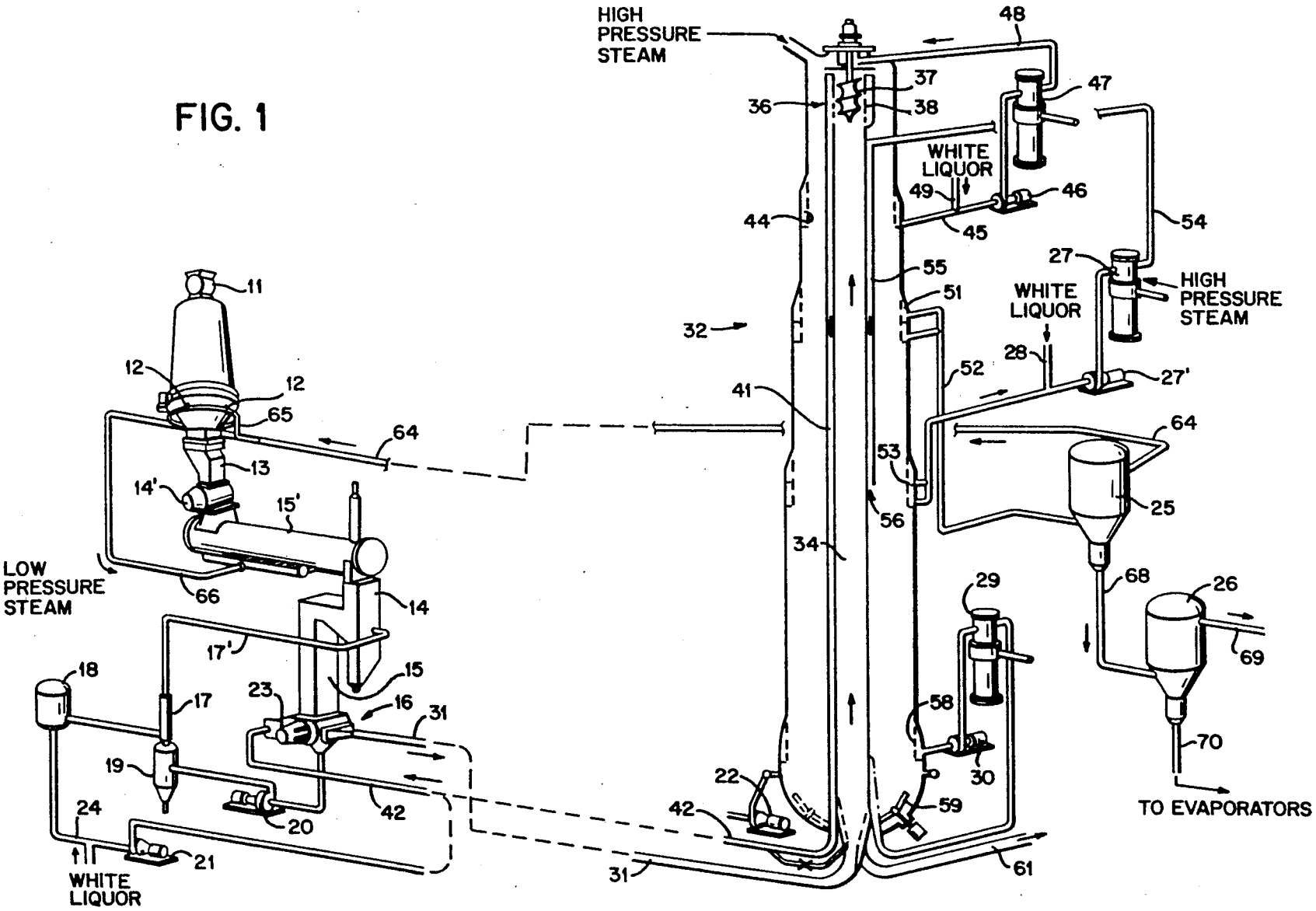
FIG. 1 is a schematic view of conventional apparatus for feeding a continuous digester of an unusual design, but with conventional black liquor recovery.
Figure 2:
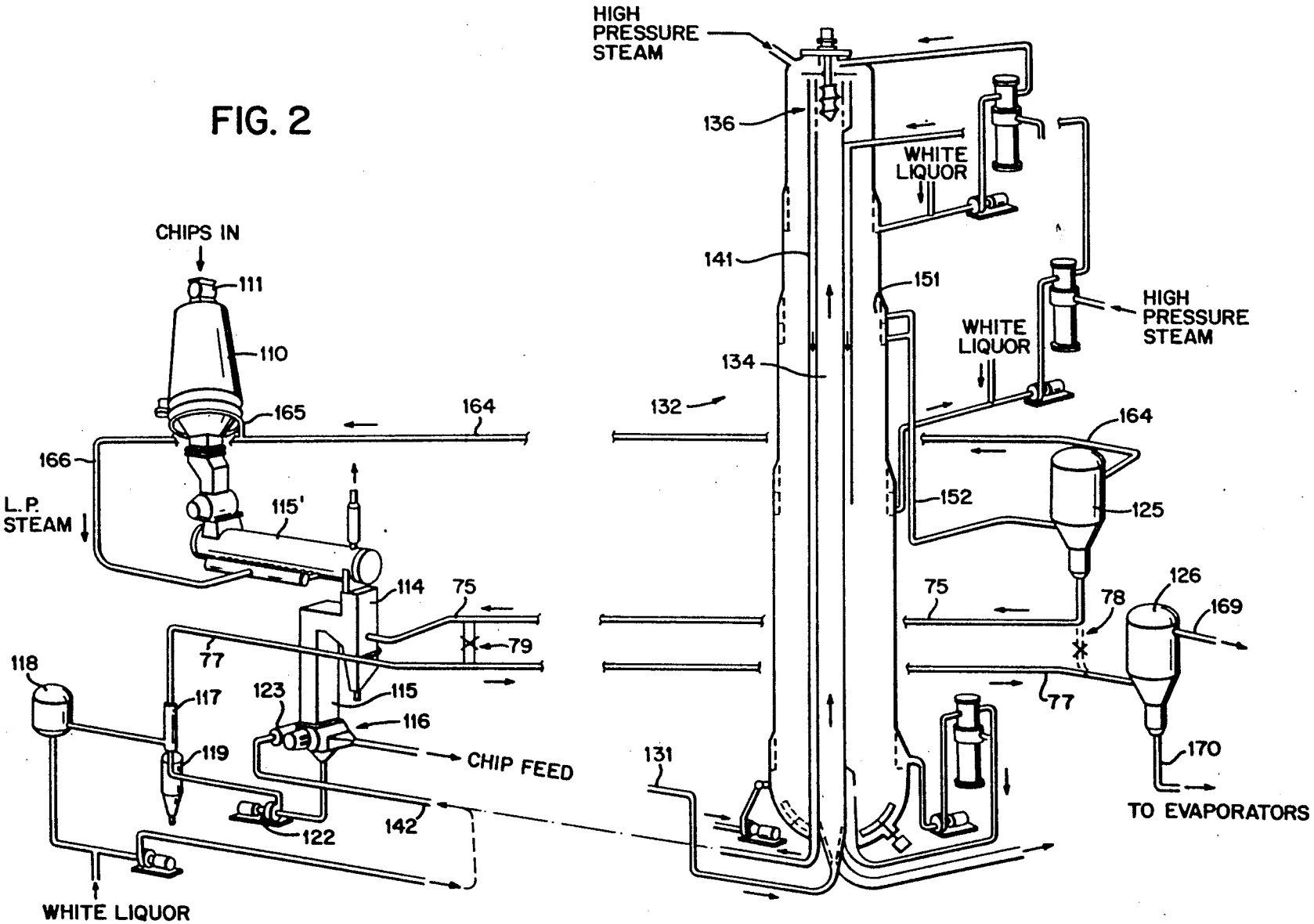
FIG. 2 is a schematic view like that of FIG. 1 only showing black liquor handling according to the present invention.
Figure 3:
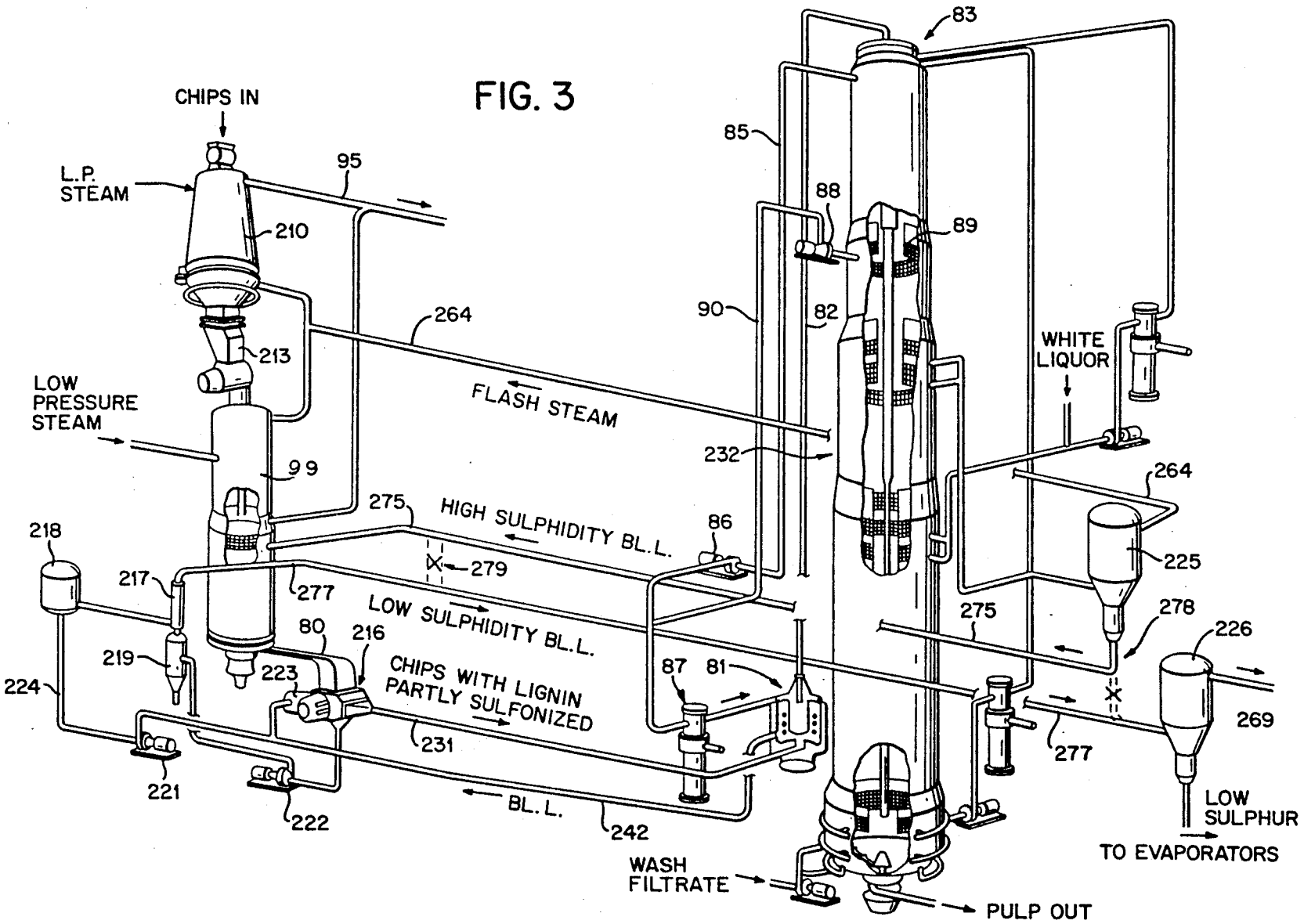
FIG. 3 is a schematic view showing a basically conventional continuous digester with feeding means modified from that of FIG. 2, and showing black liquor handling according to the invention.

Most of the components of the apparatus illustrated in FIGS. 1 through 3 are conventional in continuous digester systems. For example a chips bin 10 (preferably the vibratory type) having an air lock 11 at the top thereof has connections 12 for atmospheric bin steaming by flash steam from flash tanks 25, 26, and leads to a chip meter 13, and low pressure feeder 14' to a horizontal low pressure steaming vessel 15'. Then it flows past tramp material separator 14 into a chip chute 15 connected to the high pressure feeder 16, being slurried with liquid in chute 15. Those components are variously connected to an in-line drainer 17, a level tank 18, a sand separator 19, and various other pipes and components, such as pumps 20, 21, 22, and 23, and to the conduit 24 to which white liquor is added. Drainer 17 communicates with chute 15 via conduit 17'. Other conventional components include the flash tanks 25 and 26; heater 27 supplied with high pressure steam; white liquor input conduit 28; wash heater 29 supplied with high pressure steam; and a pump 30.

In the FIG. 1 embodiment, the continuous digester 32 is not a conventional digester, but rather is one such as shown in said co-pending application Ser. No. 07/372,650 filed June 28, 1989 entitled "Continuous Cooking with Reduced Cost, Horsepower and Pulp Degradation". This includes a concentric upflow conduit 34 leading to an in-line solids/liquid separator 36 adjacent the top of the digester 32, with an internal screw 37 and an annular screen 38. The screw 37 is driven by motor 39. The chips continue to pass upwardly past the screw 37 into the top of the digester 32 where they are heated by high pressure steam, and then flow downwardly exteriorly of the conduit 34. The separated liquid flows in conduit 41 within the digester 32 but outside the upflow conduit 34 to the line 42 ultimately to be returned to the high pressure pump 23 of the feeder 16. Screens 44 adjacent the top of the digester 32 have a line 45 extending therefrom to pump 46, high pressure steamer 47, and return conduit 48 for returning the separated liquid—once white liquor has been added by a conduit 49—to the top of the digester 32 to contact the chips immediately when they are withdrawn from the conduit 34. Withdrawn liquid from screens 51 is black liquor, which passes in line 52 to the flash tank 25.

From screens 53, liquid is withdrawn utilizing pump 27' and returned via line 54 to an interior vertical conduit 55 having an opening 56 adjacent the screens 53 through which the returned liquid, with white liquor added at conduit 28, is introduced into the chips column. Bottom screens 58 cooperate with the wash pump and heater 29 and introduce wash liquor adjacent the bottom. The pulp is ultimately withdrawn through outlet 61 at the bottom of the digester 32.

In FIG. 1, the black liquor is handled in a conventional manner. The concentrated liquor in line 68 from the flash tank 25 passes to the second flash tank 26, while the steam in line 64 passes (through line 65 to the connections 12) to be used in the chips bin 10, and/or to line 66 leading to the low pressure steaming vessel 15'. At flash tank 26 the steam is separated in line 60 wherein the doubly concentrated liquor in line 70 passes to evaporators and ultimately to chemical recovery.

In FIG. 2, exemplary apparatus according to the invention is illustrated. In the FIG. 2 embodiment structures comparable to those in the FIG. 1 embodiment are illustrated by the same reference numeral only preceded by a "1". The elements that are in common will not be further described in detail. Rather merely the difference between the system of FIG. 2 and that of FIG. 1 will be described in detail, namely the apparatus for handling the black liquor.

In the structure according to FIG. 2, the concentrated black liquor from first flash tank 125 passes in line 75 to the chips chute 115, where it provides at least the majority of liquid for slurrying the chips which have been steamed. The black liquor is maintained in intimate contact with the chips for a significant period of time. While it is maintained in contact with the chips, it partially sulfonizes the lignin in the chips. Ultimately the black liquor is separated out and white liquor or the like is added. This is accomplished primarily in the impregnation tube 134 between high pressure feeder 116 and the solids/liquid separator 136.

The low pressure outlet from the high pressure feeder 116, which is connected to pump 122, will contain a large amount of black liquor therein since the high pressure feeder 116 essentially replaces most of the slurrying liquid introduced into the low pressure inlet (chips chute) thereof with the high pressure liquid in line 142. From in-line drainer 17 the black liquor passes in line 77 to the second flash tank 126, and then to conventional recovery or disposal. If desired, a by-pass conduit 78 may be provided to allow some of the concentrated black liquor from the first flash tank 125 to pass directly to the second flash tank 126, or to force all of the black liquor to pass to tank 126 when for some reason the enhanced sulfonization according to the invention is not desired. A corresponding by-pass 79 then takes care of the low pressure flow to the high pressure feeder 116 [by-pass 79 opens as 78 shuts]. The vast majority of any black liquor that remains in line 131 and in upflow conduit 134 is separated out by the solids/liquid separator 136, and passes in return separated liquor conduit 141 to the high pressure feed line 142 for the high pressure pump 123. Of course the black liquor is ultimately replaced by white liquor or the like before the chips are actually subjected to cooking in the digester 132.

The pulp produced utilizing the system of FIG. 2 is expected to have higher quality, in particular a higher tear strength, and better beating properties.

In the FIG. 3 embodiment, structures comparable to those in the FIG. 1 embodiment are illustrated by the same reference numeral only preceded by a "2", and those comparable to the added reference numerals in the FIG. 2 embodiment are illustrated by the same reference numeral only preceded by a "2".

In the FIG. 3 embodiment, a conventional type of digester 232 is illustrated, and slurrying and steaming takes place in a vertical vessel 99 instead of the low pressure steaming vessel 115' and chips chute 115 of the FIG. 2 embodiment. In the vessel 99 low pressure steam is introduced into the top thereof while a level of slurrying liquid is maintained therein, the liquid being provided at least in part by black liquor in line 275 from first flash tank 225. The slurry passes out of the bottom of the vessel 99 into feeder conduit 80 to the low pressure inlet to high pressure feeder 216.

In the FIG. 3 embodiment, a solids/liquid separator is provided, only it is provided as a structure 81 exteriorly of the digester 232. Chips with partially sulfonized lignin passes in line 231 to the separator 81, with the chips in slurry passing upwardly in conduit 82 to the top 83 of the digester 232, while the separated out liquor passes in line 242. A part of the liquor in line 242 is fed to the high pressure pump 223 of the high pressure feeder 216, while the rest of it ultimately passes to the black liquor recovery line 277, passing to the second flash tank 226.

White liquor is added at a number of places in the FIG. 3 system. It is not added in line 224, however it is added in line 85 to pass into the top of the digester 232 to meet the chips as soon as they are introduced. A pump 86 is connected to a heater 87, and also introduces white liquor to the heater 87 and to replace the withdrawn black liquor in the separator 81. A pump 88 withdraws liquor through screens 89 adjacent the top of the vessel 232, passing in line 90 also to the heater 87 and to separator 81.

In the FIG. 3 embodiment, turpentine, or like volatiles, in lines 95 from the chips bin 210 and the steaming/slurrying vessel 99, pass to a suitable recovery station.

It will thus be seen that according to the present invention a method and apparatus have been provided to—in a simple manner—enhance the quality of chemical pulp produced in a continuous digester. While the invention has been herein shown and described in what is presently conceived to be the most practical and preferred embodiment, it will be apparent to those of ordinary skill in the art that many modifications may be made thereof within the scope of the invention, which scope is to be accorded the broadest interpretation of the appended claims so as to encompass all equivalent methods and apparatus.

What is claimed is:

1. Apparatus for continuously digesting cellulosic fibrous material to produce paper pulp, comprising:

(a) steaming means for steaming the material;

(b) liquid slurrying means for producing a liquid slurry containing the steamed material;

(c) a high pressure feeder having a low pressure inlet, low pressure outlet, high pressure inlet, and high pressure outlet;

(d) a continuous digester comprising a slurry inlet at the bottom thereof to a central upflow conduit, said upflow conduit having a solids/liquid separator adjacent the top of said digester, and a separated-out liquid conduit extending downwardly within said digester exteriorly of the upflow conduit to the bottom of said digester for removing separated out liquid from said digester and feeding it to said high pressure inlet to said high pressure feeder;

(e) black liquor withdrawal means for withdrawing black liquor from said continuous digester;

(f) a first flash tank containing a steam outlet and a concentrated liquor outlet, and an inlet connected to said digester;

(g) connecting means for interconnecting said concentrated liquor outlet from said flash tank to said slurrying means;

(h) black liquor recovery or disposal means; and (i) means for connecting said low pressure outlet of said high pressure feeder to said recovery or disposal means.

2. Apparatus as recited in claim 1 wherein said means (h) includes a second flash tank.

3. Apparatus as recited in claim 2 further comprising a line interconnecting said steam outlet from said first flash tank to said steaming means.

4. Apparatus as recited in claim 3 wherein said steaming means and said slurrying means comprises a vertically disposed vessel having a liquid level disposed therein and steam introduction means above the level of liquid disposed therein, and a slurry outlet from the bottom thereof connected to said high pressure feeder low pressure inlet.

5. Apparatus as recited in claim 3 wherein said slurrying means comprises a vertically disposed chute, and wherein said steaming means comprises a generally horizontal steaming vessel.

6. Apparatus as recited in claim 1 wherein said steaming means and said slurrying means comprises a vertically disposed vessel having a liquid level disposed therein and steam introduction means above the level of liquid disposed therein, and a slurry outlet from the bottom thereof connected to said high pressure feeder low pressure inlet.

7. Apparatus as recited in claim 1 wherein said slurrying means comprises a vertically disposed chute, and wherein said steaming means comprises a generally horizontal steaming vessel.

* * * * *

UNITED STATES PATENT AND TRADEMARK OFFICE

CERTIFICATE OF CORRECTION

PATENT NO. : 5,053,108

DATED : Oct. 1, 1991

INVENTOR(S) : RICHTER

It is certified that error appears in the above-identified patent and that said Letters Patent is hereby corrected as shown below:

ON THE TITLE PAGE:

Change "[73] Assignee: Kamyr AB, karlstad, Sweden" to --Assignee: Kamyr AB, Karlstad, Sweden--.

Column 2, line 19, change "24" to --28--.

Column 4, line 3, change "17" to --117--.

Signed and Sealed this

Twenty-sixth Day of January, 1993

*Attest:*

STEPHEN G. KUNIN

*Attesting Officer*

*Acting Commissioner of Patents and Trademarks*